US007438675B2

(12) United States Patent
Lin

(10) Patent No.: US 7,438,675 B2
(45) Date of Patent: Oct. 21, 2008

(54) ROTATORY ABDOMINAL CRUNCH MACHINE

(75) Inventor: Shih-Yuan Lin, Xiamen (CN)

(73) Assignee: Xiamen Kang Sou Fitness Co., Xiamen (CN)

( * ) Notice: Subject to any disclaimer, the term of this patent is extended or adjusted under 35 U.S.C. 154(b) by 0 days.

(21) Appl. No.: 11/678,649

(22) Filed: Feb. 26, 2007

(65) Prior Publication Data

US 2008/0207412 A1 Aug. 28, 2008

(51) Int. Cl.
*A63B 26/00* (2006.01)
*A63B 22/14* (2006.01)

(52) U.S. Cl. ..... 482/140; 482/147

(58) Field of Classification Search ..... 482/129–130, 482/146–147, 140, 110
See application file for complete search history.

(56) References Cited

U.S. PATENT DOCUMENTS 5,941,807 A * 8/1999 Cassidy et al. ..... 482/146
7,118,519 B2 * 10/2006 Slowinski ..... 482/146
2007/0298945 A1 * 12/2007 Mehta ..... 482/130

* cited by examiner

*Primary Examiner*—Fenn C Mathew
(74) *Attorney, Agent, or Firm*—Rabin & Berdo, P.C.

(57) ABSTRACT

A rotatory abdominal crunch machine mainly uses a rotating disc fitted on an eccentric revolution disc to assist the user in swinging his or her waist in circular motion so as to strengthen the abdominal muscles. A rolling element, which is embedded in said rotating disc, drives said rotating disc to rotate in 360 degrees.

10 Claims, 7 Drawing Sheets

ROTATORY ABDOMINAL CRUNCH MACHINE

BACKGROUND OF THE INVENTION

I. Field of the Invention

A rotatory abdominal crunch machine relates to a machine that assists the user in swinging his or her body to strengthen the muscles, particularly to a machine that assists the user in swinging his or her waist in circular motion so as to achieve powerful and tight abdominal muscles.

II. Description of the Prior Art

Each of the abdominal workout equipment in the market has its own motion design that assists the user in strengthening the muscles of different parts. The swing machine of the prior art mainly uses a rotating disc to assist the user's workout for strengthening the muscles. With reference to FIG. 1, which is a three-dimensional explored diagram showing a swing machine of the prior art, the swing machine 10 comprises a support rack 101, a seat rack 102, a rotating disc 104, and a seat 105. The support rack 101 is used to support the seat rack 102. The rotating disc 104, which is fitted on the seat rack 102, comprises a surface disc 1042, a base disc 1042 and a rolling element 1043, which is embedded in said base disc 1042. Surface disc 1041 of the rotating disc 104 is fitted beneath a seat 105. An anti-slip belt 1031, which girds said surface disc 1041, holds a pound-force adjuster 1032 on one of its ends. The rolling element 1042 embedded in the rotating disc 104 allows said rotating disc 104 to rotate. The user sits on seat 105 fitted on the rotating disc 104 and swings his or her waist so as to strengthen the abdominal muscles. However, the swing machine of the prior art not really offers circular motion that allows the user to completely exercise the abdominal muscles.

SUMMARY OF THE INVENTION

Main objective of the present invention is to offer a rotatory abdominal crunch machine that allows the user to properly perform abdominal exercises and achieve results in the most efficient manner. Moreover, it aims at offering a machine that is easy for anyone to use and takes not much space for storage.

Further aspects, objects, and desirable features of the present invention will be better understood from the detailed description and drawings that follows in which various embodiments of the disclosed invention are illustrated by way of examples.

DESCRIPTION OF THE PREFERRED EMBODIMENTS

Figure 1:
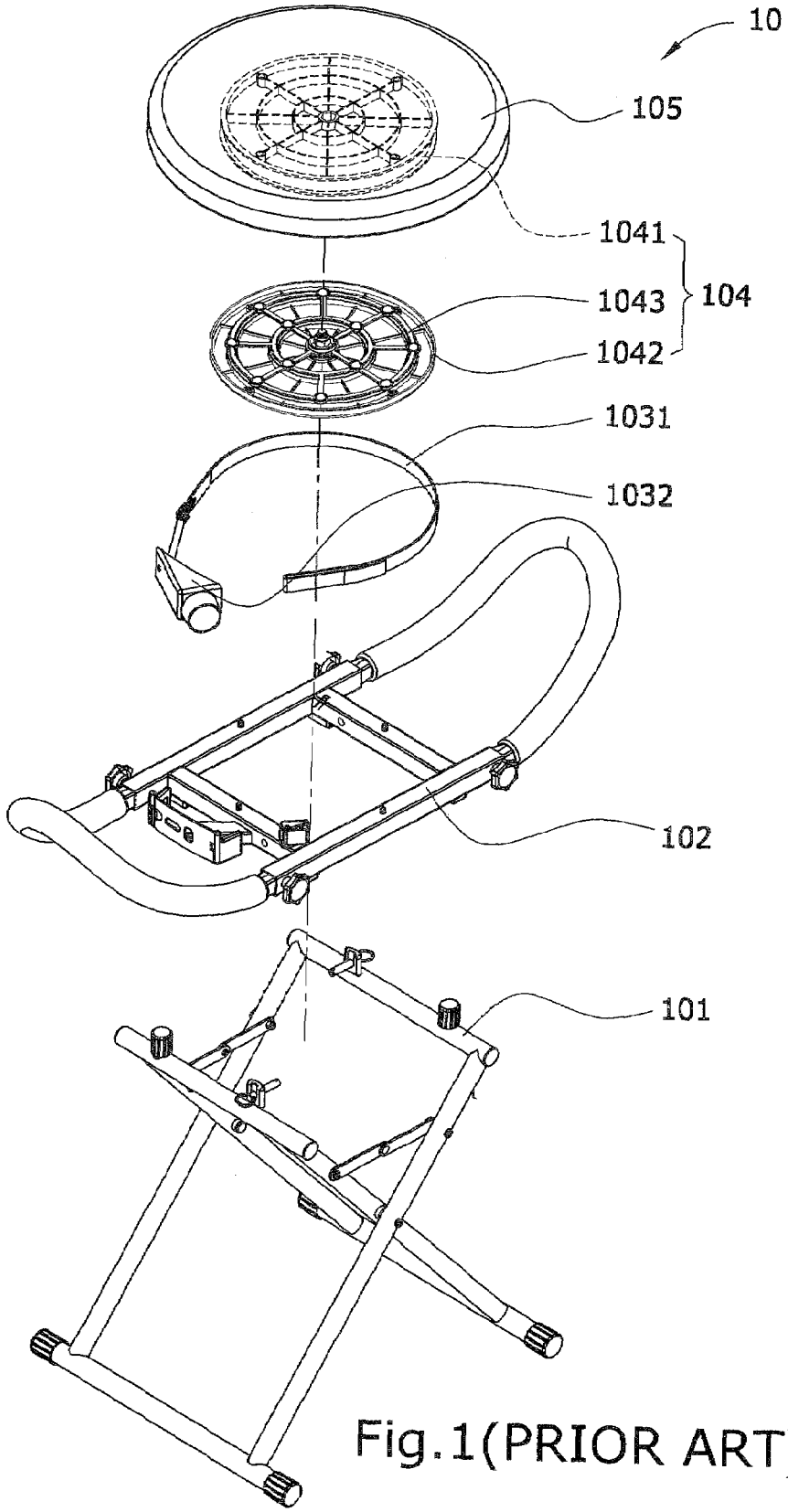
Fig.1(PRIOR ART)
FIG. 1 is a three-dimensional view showing explored diagram of a swing machine of the prior art.
Figure 2:
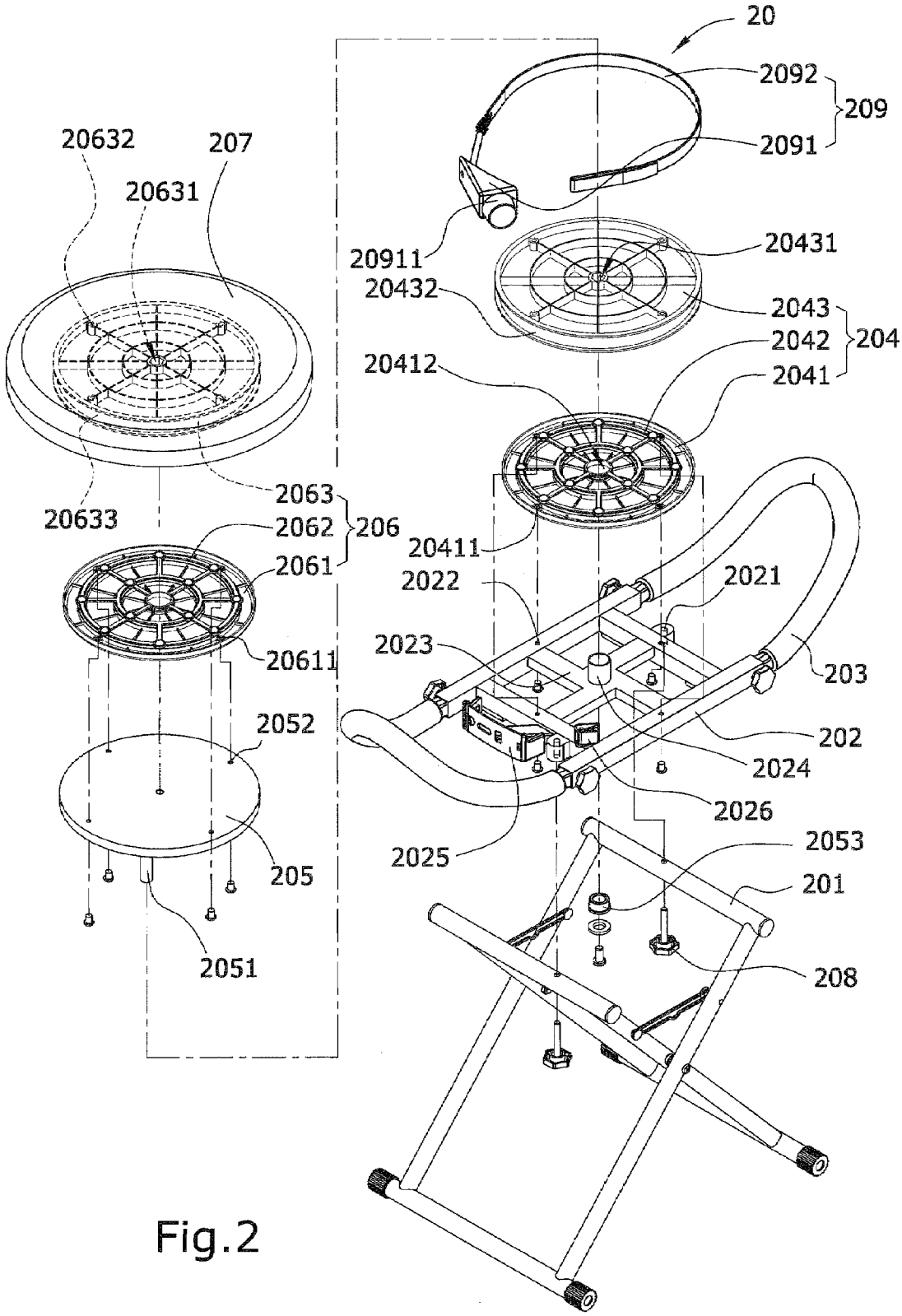
FIG. 2 is a three-dimensional view showing explored diagram of the invention.

With reference to FIG. 2, which is a three-dimensional explored diagram of the present invention, the rotatory abdominal crunch machine 20 comprises a support rack 201, a seat rack 202, a pound-force adjuster 209, a first rotating disc 204, a revolution disc 205 and a second rotating disc 206. The pane-shaped seat rack 202 comprises two handrails 203, which are screwed in on right and left sides, a plurality of holes 2021, which are formed on left and right bars. Fit a plurality of knobs 208 into holes 2021 so as to fasten the seat rack 202 on the support rack 201. A plurality of assembly holes 2022 is formed on surface of the seat rack 202. Corresponding to which, a plurality of assembly hole 20411 are formed on rim of base disc 2041 of the first rotating disc. Fit those assembly holes 2022, 20411 together so as to fit the first rotating disc 204 on the seat rack 202. The first rotating disc 204 comprises a surface disc 2043, a base disc 2041 and a rolling element 2042. The rolling element 2042 is embedded in the base disc 2041. For assembly, the base disc 2041 and the surface disc 2043 both have a hole 20412, 20431 formed on their centers, corresponding to the other. The surface disc 2043 is encircled with a friction ring 20432. A rib 2023 is formed in the center of the seat rack 202, and a hollow rod 2024 is formed on the rib 2023. The hollow rod can skewer the surface disc 2043 and the base disc 2041 by passing through holes 20412, 20431 formed thereon. An outrigger 2025 and a buckle 2026 are formed on one side of the seat rack 202 so as to support the pound-force adjuster 209. The pound-force adjuster 209 comprises a holder 2091 and an anti-slip belt 2092. Insert one end of the anti-slip belt 2092 into the holder 2091 and fasten the other end with the buckle 2026 so that the anti-slip belt 2092 can gird the friction ring 20432. Turn the knob 20911 on the holder 2091 to fasten or loose the anti-slip belt 2092 so as to adjust the pound force of the first rotating disc 204. An eccentric cylinder 2051 is formed on bottom of the revolution disc 205 and has a bearing 2053 fitted in. Fit the eccentric cylinder 2051 into the hollow rod 2024 so that the revolution disc 205 can make eccentric rotation. Assembly the second rotating disc 206 and the revolution disc 205 by fitting together a plurality of assembly holes 2052, 20611 formed thereon. The second rotating disc 206 comprises a surface disc 2063, a base disc 2061 and a rolling element 2062. The rolling element 2062 is embedded in the base disc 2061. The surface disc 2063, which comprises a hole 20631 formed in the center and a plurality of assembly holes 20632 formed on the surface, is encircled by a friction ring 20633 and installed beneath a seat cushion 207.

Figure 3:
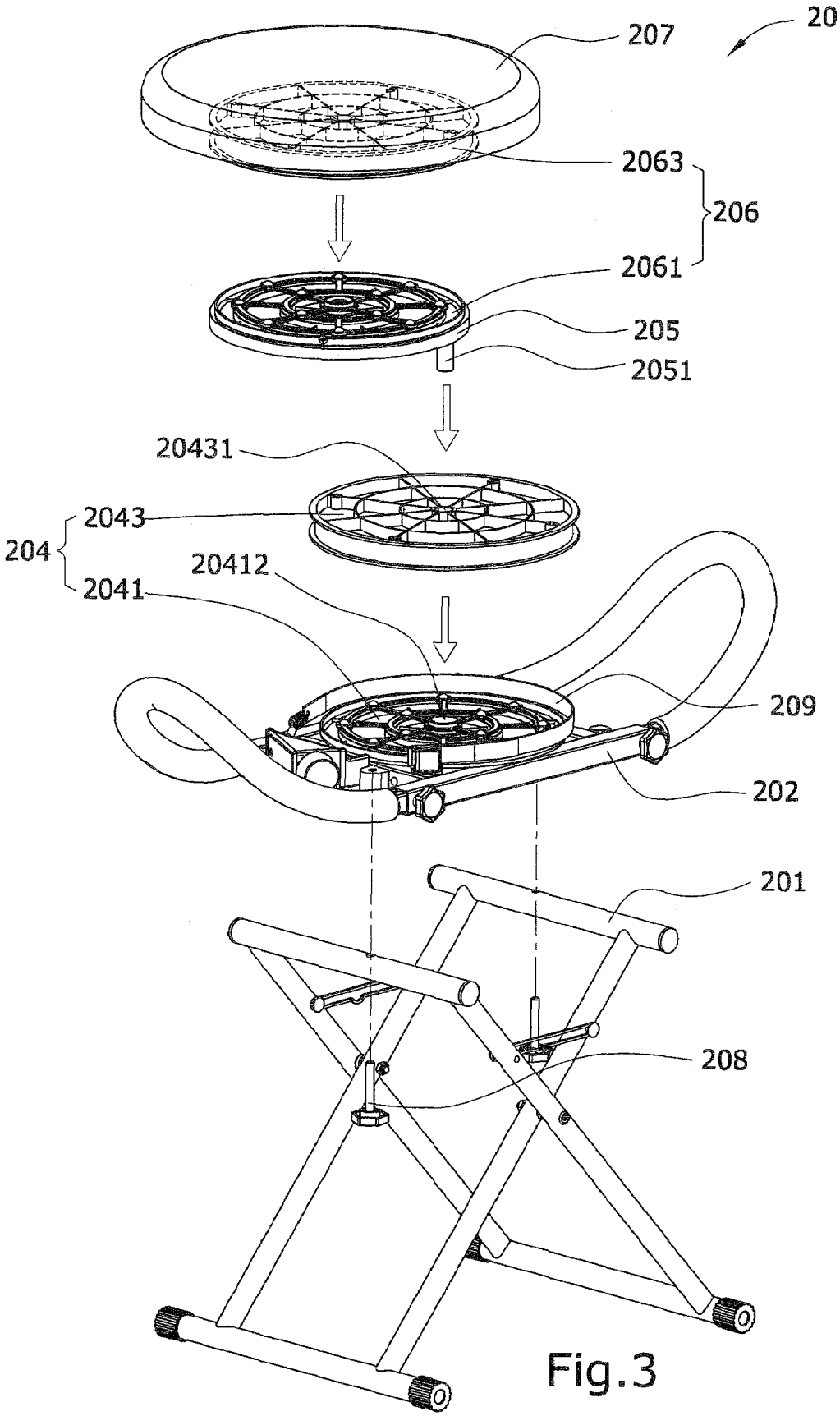
FIG. 3 is a sectional view showing assembly of the invention.

With reference to FIG. 3, which shows assembly of the present invention, the rotatory abdominal crunch machine 20 comprises a support rack 201, a seat rack 202, a pound-force adjuster 209, a first rotating disc 204, a revolution rotating disc 205 and a second rotating disc 206. Fasten the seat rack 202 on the support rack 201 with a plurality of knobs 208. Fit base disc 2041 of the first rotating disc 204 on the support rack 202. Place the surface disc 2043 on the first rotating disc 204. Assemble the pound-force adjuster 209, the seat rack 202 and the surface disc 2043 of first rotating disc 204. Fit the base disc 2061 of second rotating disc 206 on the revolution disc 205. Fit the surface disc 2063 beneath the seat cushion 207 and put the base disc 2061 under said surface disc 2063 so as to fit the second rotating disc 206 beneath the seat cushion 207. Pass the eccentric cylinder 2051, which is formed on bottom of the revolution disc 205, through the holes 20412,

20431, which are formed in the center of the first rotating disc 204. Assembly of the rotatory abdominal crunch machine is thus complete.

Figure 4:
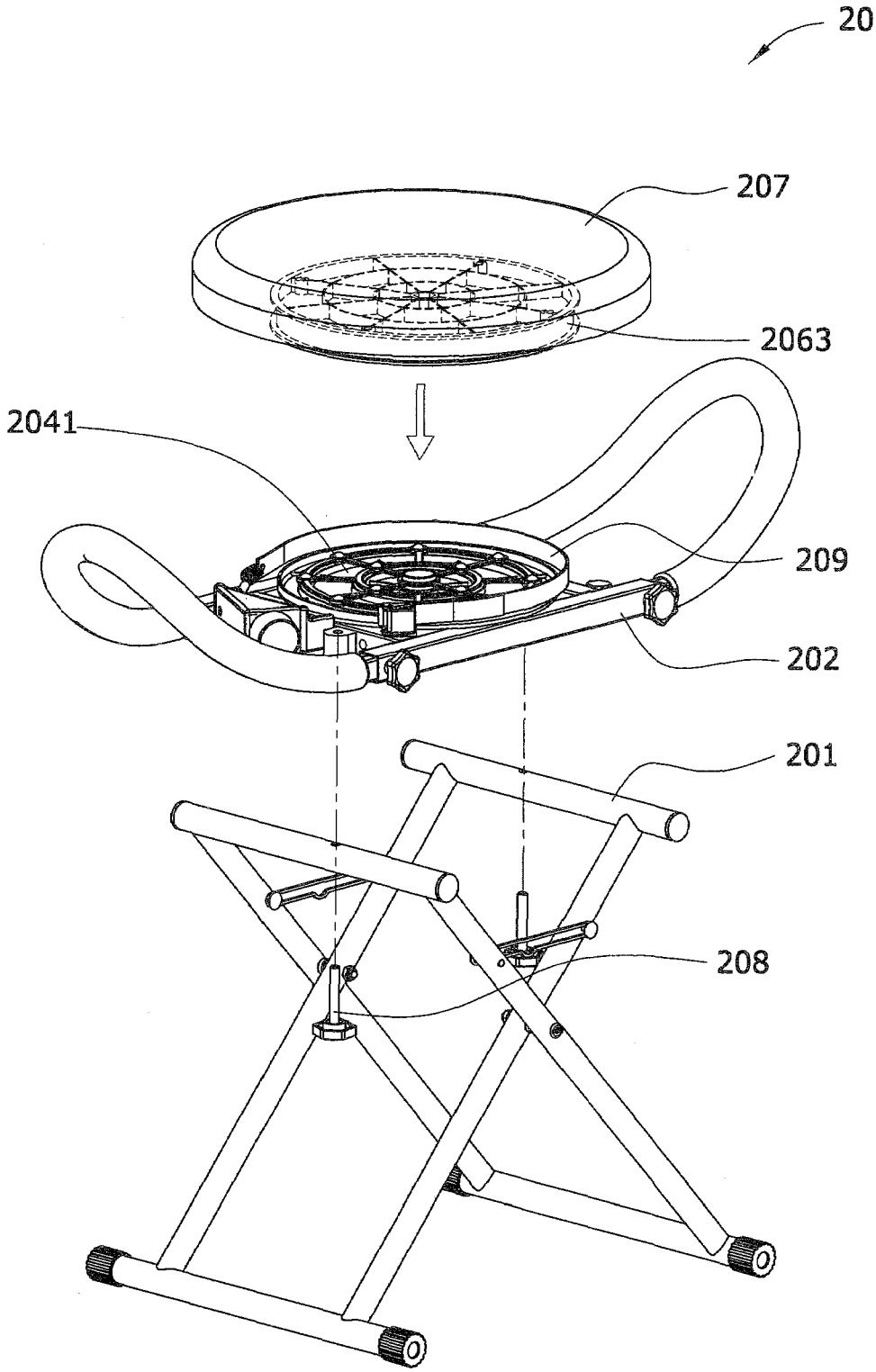
FIG. 4 is a sectional view of another embodiment of the invention.

With reference to FIG. 4, which shows another embodiment of the present invention, the rotatory abdominal crunch machine 20 comprises a support rack 201, a seat rack 202, a pound-force adjuster 209, a first rotating disc and a second rotating disc. The base disc 2041 comprised in the first rotating disc 204 and the surface disc 2063 comprises in the second rotating disc 206 are identical to those of the foregoing embodiment, shown in FIG. 3. Fasten the seat rack 202 on the support rack 201 with a plurality of knobs 208. Fit the base disc 2041 of first rotating disc 204 on the seat rack 202. Fit the surface disc 2063 of second rotating disc 206 beneath the seat cushion 207 and cover the base disc 2041 of first rotating disc. Fit together the pound-force adjuster 209, the seat support 202 and the surface disc 2063 of second rotating disc 206. Assembly of the rotatory abdominal crunch machine 20 is complete. It can thus swing.

Figure 5:
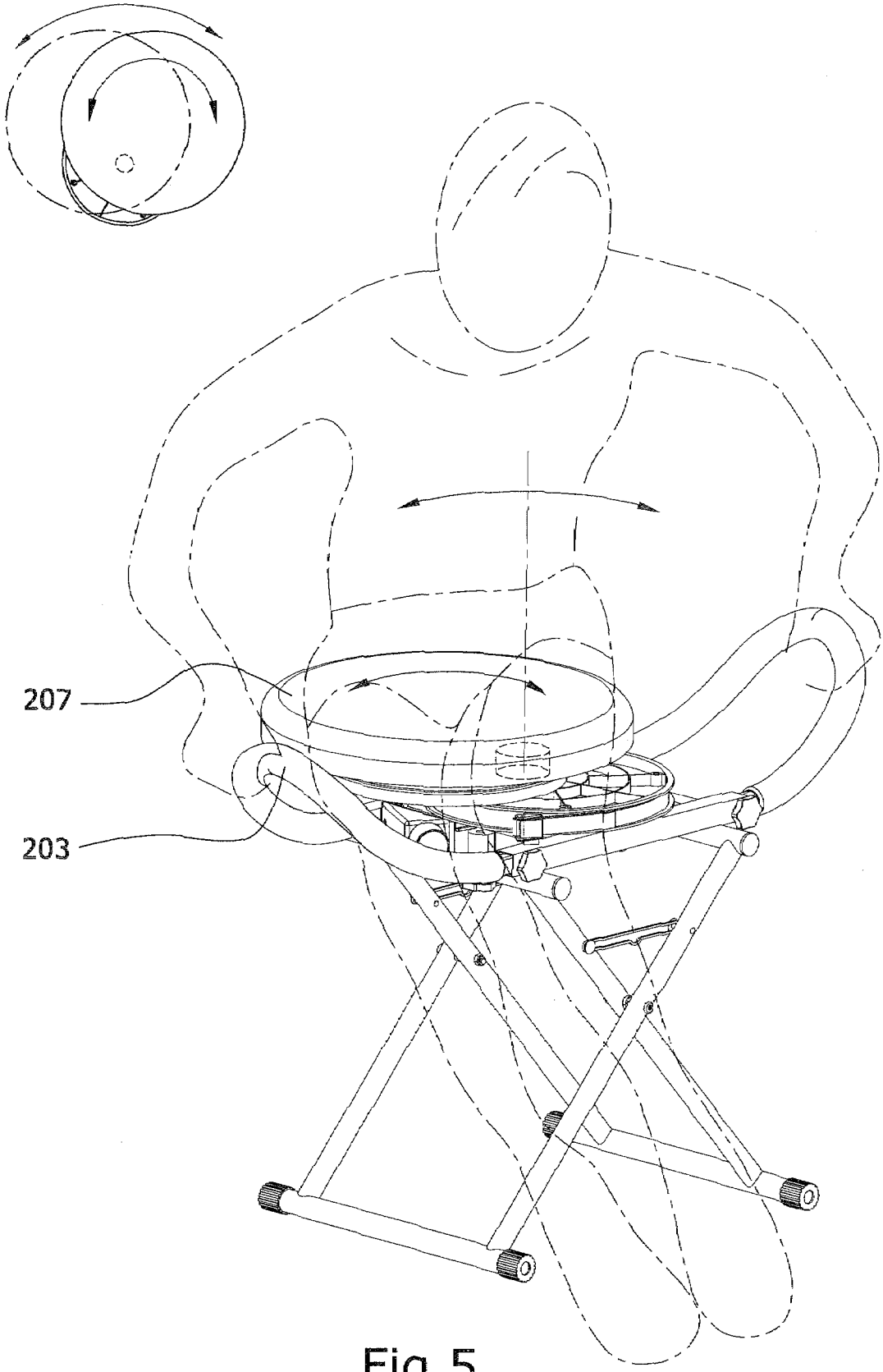
FIG. 5 is a sectional view of embodiment I of the invention.

With reference to FIG. 5, which is a sectional view of embodiment I of the present invention, the rotatory abdominal crunch machine assists the user in swinging his or her waist so as to strengthen the abdominal muscles. While doing workout with the machine, the user is to sit on seat cushion 207, properly grip the handrails 203, keep his or her legs close and put his or her feet on the ground.

Figure 6:
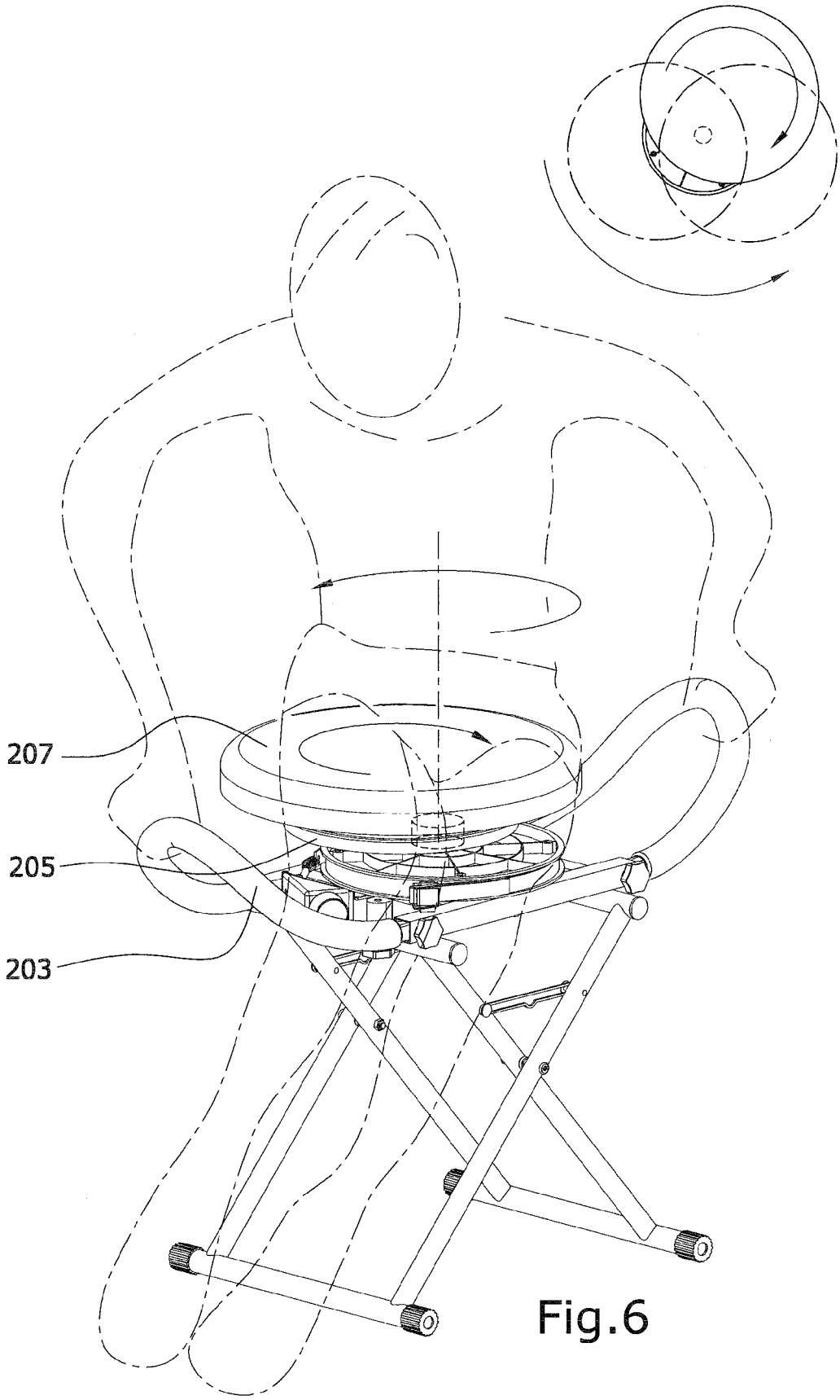
FIG. 6 is a sectional view of embodiment II of the invention.

With reference to FIG. 6, which is a sectional view of embodiment II of the present invention, the rotatory abdominal crunch machine assists the user in swinging his or her waist in a circular motion so as to strengthen the abdominal muscles. The circular motion is driven by user's own force produced from swinging his or her waist as well as eccentric rotation of the revolution disc 205. While doing workout with the machine, the user is to sit on seat cushion 207, properly grip the handrails 203, keep his or her legs close and put his or her feet on the ground.

Figure 7:
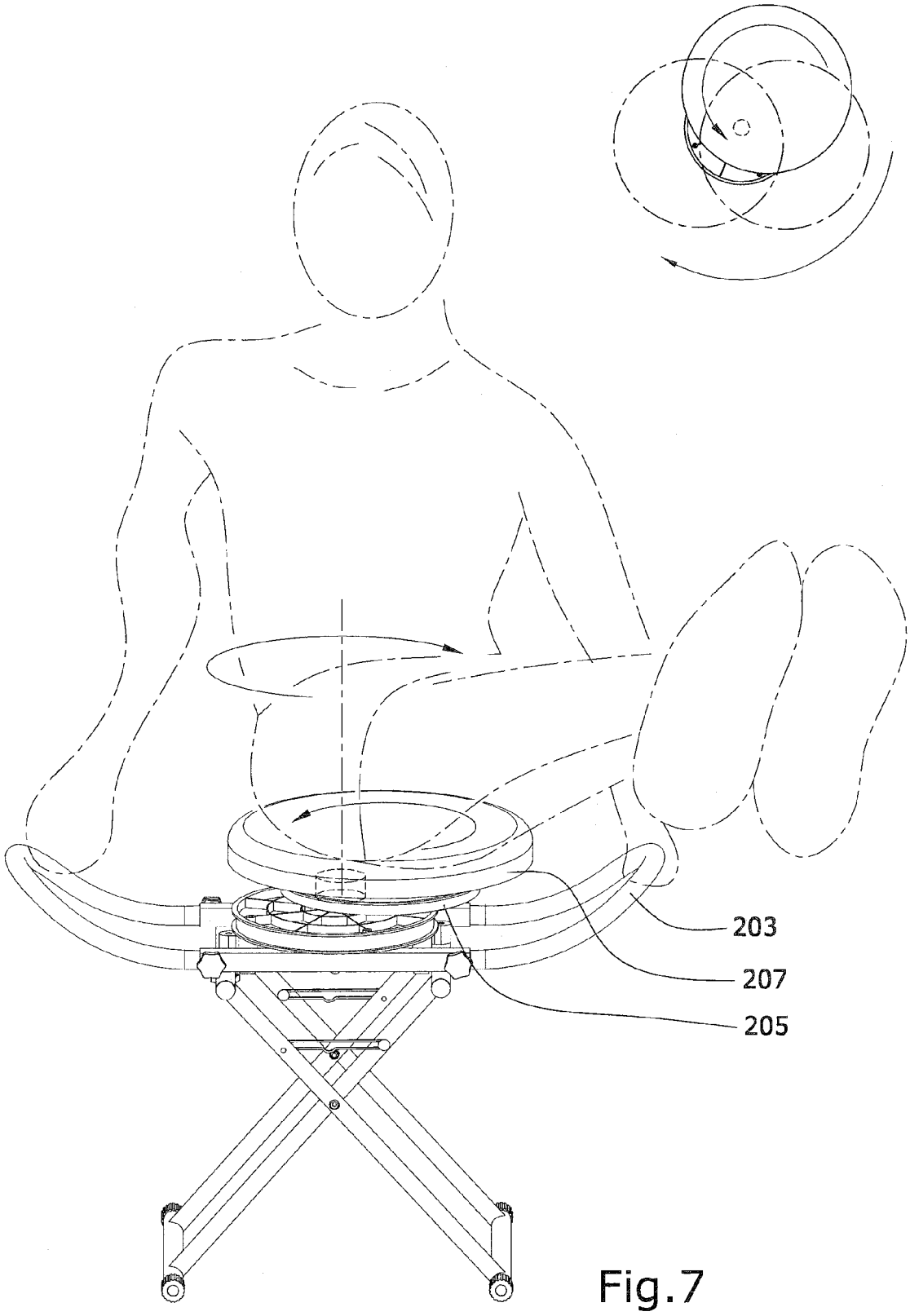
FIG. 7 is a sectional view of embodiment III of the invention.

With reference to FIG. 7, which is a sectional view of embodiment III of the present invention, the rotatory abdominal crunch machine assists the user in swinging his or her waist in a circular motion so as to achieve powerful and tight abdominal muscles. The circular motion is driven by user's own force produced from swinging his or her waist as well as eccentric rotation of the revolution disc 205. While doing workout with the machine, the user is to sit on seat cushion 207, well grip the handrails 203, keep his or her legs close and lifted up.

Accordingly, the rotatory abdominal crunch machine is easy for anyone to use for strengthening the abdominal muscles. Besides, it takes not much space for storage.

While the present invention is susceptible to various modifications and alternative forms, specific embodiments have been shown by way of example in the drawings and described in detail herein. However, it should be understood that the invention is not intended to be limited to the particular form disclosed. Rather, the invention is to cover all modifications, equivalents, and alternatives falling within the spirit and scope of the invention as defined by the appended claims.

To sum up, the present invention achieves in offering a rotatory abdominal crunch machine that possess the practicability and the advancement of the industry.

What is claimed is:

1. A rotatory abdominal crunch machine, comprising:

a support rack;

a seat rack fitted on the support rack, and including a rib formed in a center of the seat rack, a hollow rod formed on the rib, and a plurality of holes formed on two sides of the seat rack so as to fit the seat rack on the support rack;

a first rotating disc fitted on the seat rack, and including a central hole for receiving the hollow rod of the seat rack;

a revolution disc including an eccentric cylinder that protrudes from a bottom surface of the revolution disc, the eccentric cylinder being fitted into the hollow rod of the seat rack, the eccentric cylinder having a rolling element fitted therein; and a second rotating disc fitted on the revolution disc.

2. The rotatory abdominal crunch machine of claim 1, further comprising a friction ring that encircles the first rotating disc.

3. The rotatory abdominal crunch machine of claim 1, further comprising a friction ring that encircles the second rotating disc.

4. The rotatory abdominal crunch machine of claim 1, further comprising two handrails installed on the two sides of the seat rack.

5. The rotatory abdominal crunch machine of claim 1, further comprising:

a buckle formed on one side of the seat rack;

a pound-force adjuster including an anti-slip belt and a holder, one end of the anti-slip belt being inserted into the holder, the other end of the anti-slip belt being fastened with the buckle.

6. The rotatory abdominal crunch machine of claim 1, wherein the seat rack is fitted on the support rack by a plurality of knobs.

7. The rotatory abdominal crunch machine of claim 1, further comprising a seat cushion fitted on the second rotating disc.

8. The rotatory abdominal crunch machine of claim 1, wherein the seat rack is pane-shaped.

9. The rotatory abdominal crunch machine of claim 1, wherein the revolution disc eccentrically rotates around the hollow rod of the seat rack.

10. The rotatory abdominal crunch machine of claim 9, wherein the first rotating disc includes a rolling element that allows the first rotating disc to rotate.

* * * * *